US007438013B2

(12) United States Patent
Mizutani

(10) Patent No.: US 7,438,013 B2
(45) Date of Patent: Oct. 21, 2008

(54) STEERING MECHANISM FOR SMALL BOAT HAVING MULTIPLE PROPULSION UNITS

(75) Inventor: Makoto Mizutani, Hamamatsu (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 11/536,473

(22) Filed: Sep. 28, 2006

(65) Prior Publication Data

US 2007/0068438 A1 Mar. 29, 2007

(30) Foreign Application Priority Data

Sep. 29, 2005 (JP) ..... 2005-284993

(51) Int. Cl.
*B63H 25/00* (2006.01)

(52) U.S. Cl. ..... 114/144 RE; 114/144 R

(58) Field of Classification Search ..... 440/84, 440/87; 114/144 R, 144 RE; 701/21
See application file for complete search history.

(56) References Cited

U.S. PATENT DOCUMENTS

| | | | | |
|---|---|---|---|---|
| 6,994,046 | B2 | 2/2006 | Kaji et al. | |
| 6,997,763 | B2 | 2/2006 | Kaji | |
| 7,063,030 | B2 | 6/2006 | Mizutani | |
| 7,153,174 | B2 * | 12/2006 | Takada et al. | 440/1 |
| 7,267,068 | B2 * | 9/2007 | Bradley et al. | 114/144 R |
| 2005/0263058 | A1 * | 12/2005 | Suemori et al. | 114/144 R |
| 2006/0014447 | A1 * | 1/2006 | Okuyama | 440/84 |
| 2006/0037522 | A1 | 2/2006 | Kaneko et al. | |
| 2006/0240720 | A1 * | 10/2006 | Yamashita et al. | 440/1 |

FOREIGN PATENT DOCUMENTS

| | | |
|---|---|---|
| JP | 01-285486 | 11/1989 |
| JP | 04-038297 | 2/1992 |

* cited by examiner

*Primary Examiner*—Ed Swinehart
(74) *Attorney, Agent, or Firm*—Knobbe, Martens, Olson & Bear, LLP

(57) ABSTRACT

A small boat comprises a steering wheel and a steering angle sensor that detects a steering angle of the steering wheel. A plurality of propulsion units are mounted to a transom of the boat. Electrically operable steering devices are coupled with the respective propulsion units. A control unit controls an output of each of the propulsion units. The controller adjusts the output, a trim angle or a height of a propeller of the propulsion units in accordance with the steering angle and a running condition of the boat to control a total thrust and a total running direction of the respective propulsion units.

7 Claims, 11 Drawing Sheets

STEERING MECHANISM FOR SMALL BOAT HAVING MULTIPLE PROPULSION UNITS

CROSS-REFERENCE TO RELATED APPLICATIONS

This application claims the priority under 35 U.S.C. § 119(a)-(d) of Japanese Patent Application No. 2005-284993, filed on Sep. 29, 2005, which is hereby incorporated by reference in its entirety.

BACKGROUND OF THE INVENTION

1. Field of the Invention

The present invention generally relates to a small boat comprising a plurality of propulsion units. More particularly, the present invention relates to a control device to simplify operation of the small boat while conducting turning operations.

2. Description of the Related Art

An outboard motor mounted to a transom of a small boat functions as a steering device. A drive unit of the outboard motor pivots about an axis of a swivel shaft by a turning angle dictated by a steering angle of a steering wheel. When thrust is applied to the hull of the boat, e.g., the outboard motor pushes against the transom, the boat turns in accordance with the turning angle.

An electrically operable steering device that interconnects the outboard motor to the steering wheel is disclosed in Japanese Patent Document JP-B-2959044. By the use of the electrically operable steering device, a motor is driven to cause the outboard motor to turn as directed by the steering angle of the steering wheel. Thereby, steering can be easily accomplished. While the boat is turning, the outboard motor applies a side thrust to the transom.

The output of the outboard motor is adjusted by manipulating an accelerator lever provided in a cockpit together with the steering wheel. The accelerator lever has a neutral range that covers a certain angle of a central portion of the control device. When the lever is pivoted forward from the neutral range, the lever moves to a forward shift position and a throttle valve opens to correspond to an angle of the lever (e.g., more of an angle at the lever results in a more open throttle valve), thereby increasing the output of the outboard motor to move forward. Conversely, when the lever is pivoted rearward, the lever moves to a reverse shift position and the output of the outboard motor is varied.

If a boat has two outboard motors mounted to the transom side by side, each of the outboard motors has an accelerator lever of its own so that the output of the respective outboard motors can be individually adjusted.

FIGS. 8(A) and 8(B) illustrate turning operations of a boat having multiple outboard motors (two outboard motors in this illustration). FIG. 8(A) shows a large turning angle turning operation, while FIG. 8(B) shows a small turning angle turning operation.

In FIG. 8(A), pivotal moments M1, M2 are made around the center of turn by thrust (F) generated in accordance with the output of the outboard motors 3*a*, 3*b*, which are mounted to a transom board 2 of a hull 1. With small turning angles, such as that shown in FIG. 8(B), the pivotal moments M3, M4 made around the center of turn by the thrust (F) of the respective outboard motors 3*a*, 3*b* affect the hull 1 in opposite directions relative to each other. Therefore, in such a state, the turning operation can be more efficiently made if the output of the outboard motor 3*a* is reversed (i.e., the reverse shift position). If, however, the output is reversed, the total forward thrust is reduced. The smaller thrust does not significantly effect low speed operation. At higher speed operation, energy loss may be noticed by an operator of the small boat. Also, it is almost impossible to shift one of the outboard motors to the reverse mode in a high speed operational range close to full throttle operation.

Accordingly, when two outboard motors are used, the accelerator levers of the respective outboard motors typically are operated individually depending upon the running condition, such as, for example, a steering angle, a speed or an acceleration corresponding to the steering angle and/or a shift position, while the steering angle is given by the steering wheel; however, such a configuration can be improved.

Japanese Patent Document JP-A-Hei 1-285486 discloses a boat control device by which thrust directions and magnitudes of two propulsion units can be optimized. The control device of Japanese Patent Document JP-A-Hei 1-285486 has an omni directional commanding device such as, for example, a joystick instead of a steering wheel. The steering angles of the respective propulsion units are varied in accordance with the directions given by the joystick and the thrusts thereof are also changed. Thus, the boat is turned in accordance with the commands given through the joystick.

The control device of Japanese Patent Document JP-A-Hei 1-285486 is complicated due to the addition of the joystick to the steering wheel. The control device changes the turning directions of the respective propulsion units. That is, the control device changes the directions of the individual thrusts of the propulsion units in a horizontal plane. Because of this feature, the individual thrusts can cancel each other under certain conditions depending upon the turning radius of the boat or a speed of the boat. Cancelling of the thrusts can cause perceptible energy loss.

SUMMARY OF THE INVENTION

Accordingly, a system is desired that can enhance turning operations of a small boat that has multiple propulsion units. The boat preferably is able to turn without manually operating an accelerator lever, manually adjusting outputs of the respective outboard motors in accordance with a running condition such as, for example, a speed. In short, the system preferably is able to easily and efficiently turn the small boat solely by operating a steering wheel or other steering input device.

One aspect of the present invention involves a small boat comprising a steering wheel, a steering angle sensor adapted to detect a steering angle of the steering wheel and a plurality of propulsion units mounted to a transom of the boat. Each of the plurality of propulsion units is coupled to an electrically operable steering device. A control unit is adapted to independently control an output of each of the plurality of propulsion units. The control unit adjusts the output, a trim angle or a height of a propeller of each of the plurality of propulsion units in accordance with the detected steering angle and a running condition of the boat such that a total thrust of the plurality of propulsion units and running direction of each of the plurality of propulsion units can be used to effect turning operations of the boat.

BRIEF DESCRIPTION OF THE DRAWINGS

These and other features, aspects and advantages of the present invention will now be described with reference to the drawings of a preferred embodiment, which embodiment is intended to illustrate and not to limit the invention, and in which figures.

DETAILED DESCRIPTION OF THE PREFERRED EMBODIMENT

Figure 1:
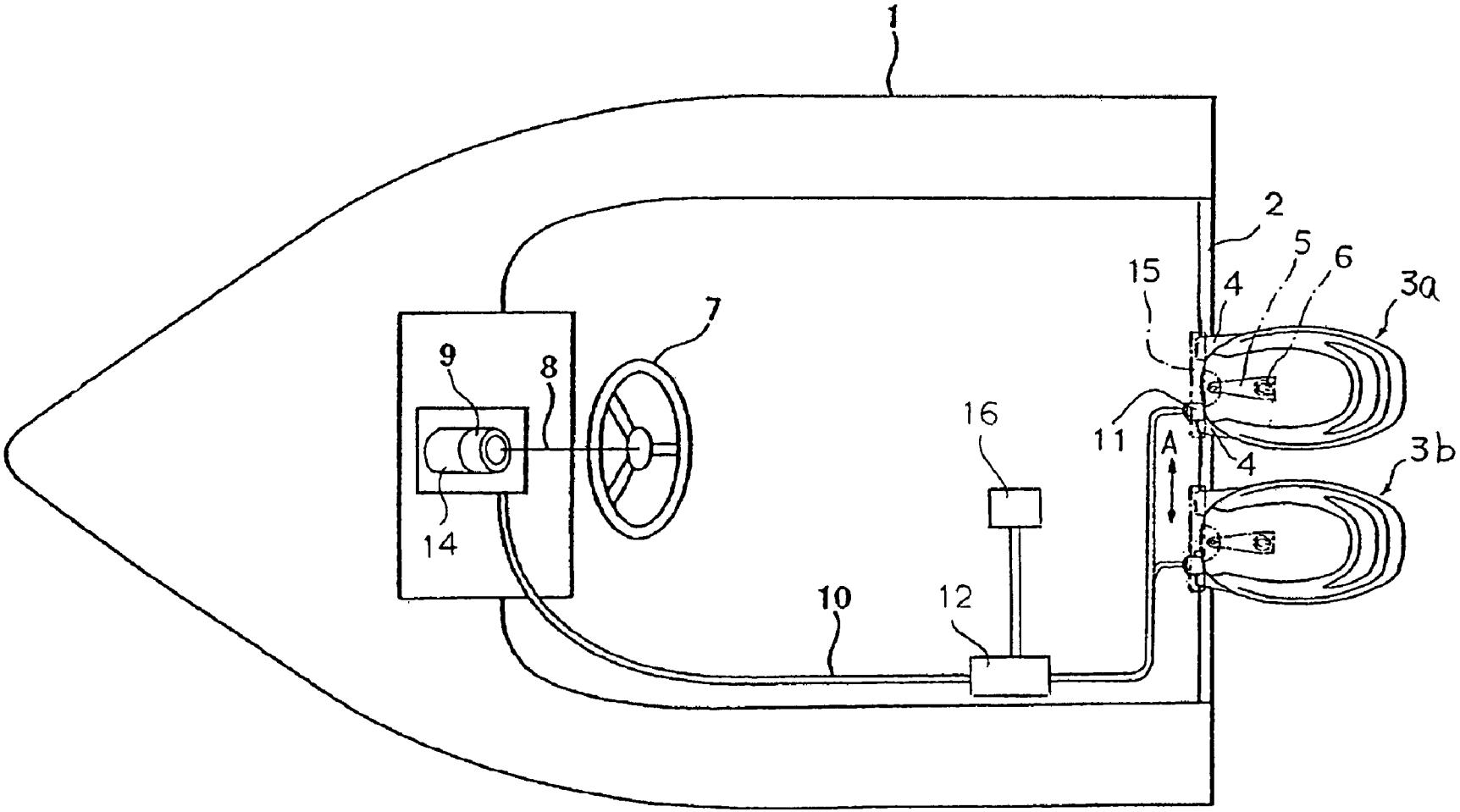
FIG. 1 is a top plan view of a small boat that is arranged and configured in accordance with certain features, aspects and advantages of an embodiment of the present invention.

With reference initially to FIG. 1, a small boat that is arranged and configured in accordance with certain features, aspects and advantages of an embodiment of the present invention is illustrated therein. The small boat comprises two propulsion units mounted generally side by side in a generally parallel manner. The small boat, while illustrated with dual outboard motors, can feature other numbers and types of propulsion units. For example, outboard motors, stern drives or the like can be mounted to a stern of the small boat. For ease of understanding the following description, the propulsion unit will be described hereinafter using the term "outboard motor;" however, the use of "outboard motor" is not intended to limit certain features, aspects and advantages of the present invention to outboard motors but is intended to be used in a broad manner to include other types of propulsion units, including stern drives and the like unless specifically stated otherwise.

Figure 10:
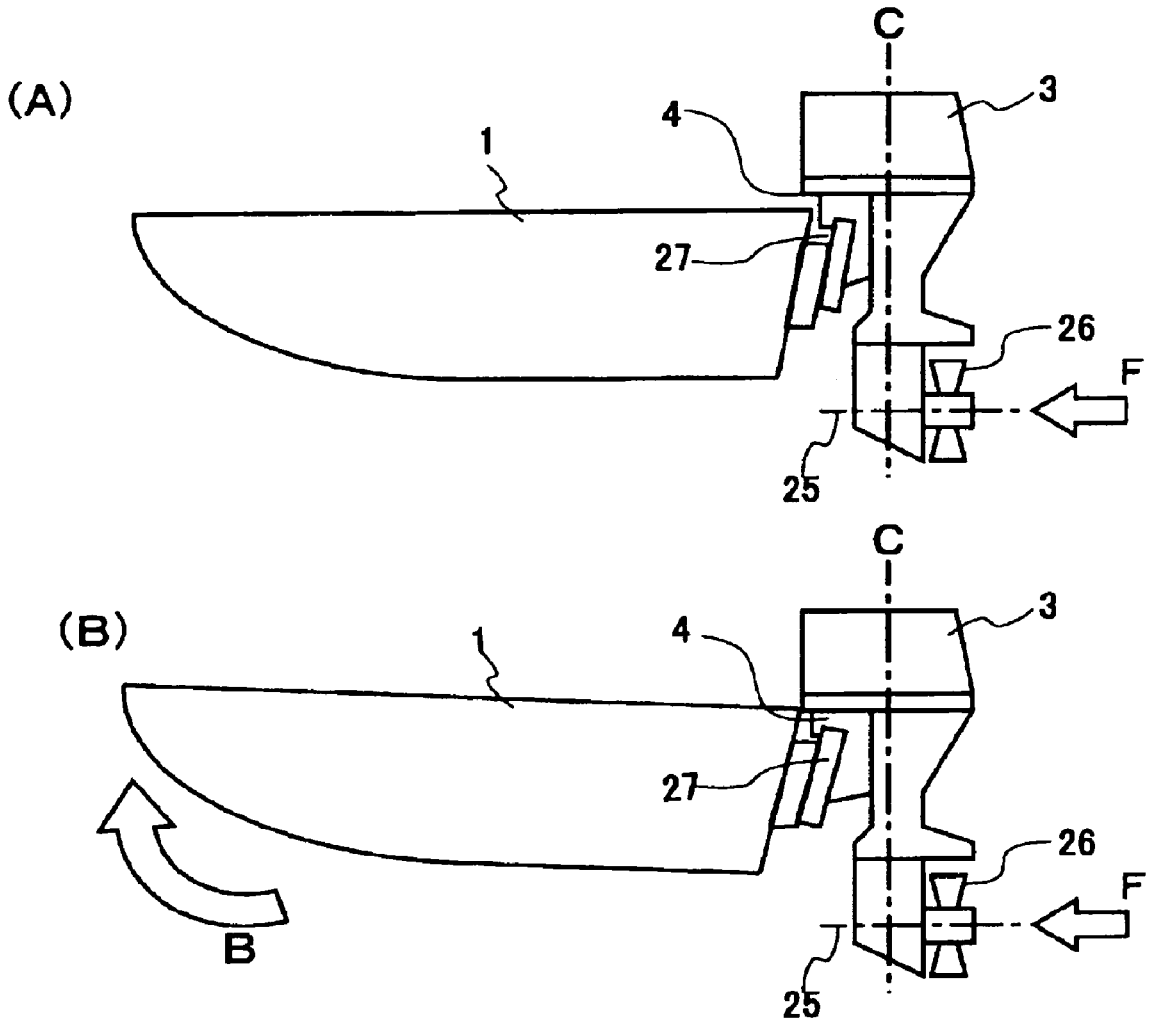
FIGS. 10(A) and 10(B) are illustrations used to explain a height adjustment of a propeller.

With continued reference to FIG. 1, the respective outboard motors 3*a*, 3*b* in the illustrated configuration are mounted to a transom board 2 of a hull 1 by individual clamping brackets 4. Other configurations are possible. Preferably, a vertical position of each of the outboard motors can be adjusted while the small boat is underway (see FIGS. 10(A) and 10(B) which will be described later).

Each outboard motor 3*a*, 3*b* preferably is pivotable about an axis defined by a swivel shaft (i.e., a generally vertically extending shaft) 6. A steering bracket 5 is fixed to a top end of each swivel shaft 6. An electric motor type steering device 15 (see FIG. 3) can be coupled with a forward portion of each steering bracket 5. When an electric motor of the steering device 15 slides as indicated by the arrow (A), the associated outboard motor 3*a*, 3*b* pivots about the swivel shaft 6. Movement of the electric motor can be controlled to generally correspond to the commanded turning angle. In one embodiment, the respective outboard motors 3*a*, 3*b* and steering devices 15 are connected to a control unit (ECU) 12 through controllers 11. The control unit 12 preferably controls an engine output of each outboard motor and the turning angle of each steering device 15.

Each outboard motor 3*a*, 3*b* can be pivoted about an axis of a tilt shaft by a tilt cylinder device (not shown). Any suitable tilt cylinder device can be used. The outboard motors 3*a*, 3*b* also can be raised to a generally horizontal position when the boat is shored. A trim angle of each outboard motor can be adjusted while the boat is underway. Thus, a thrust direction of a propeller can be moved upward or downward in a generally vertical plane (see FIGS. 9(A) and 9(B) which will be described later).

With reference again to FIG. 1, a steering wheel 7 can be positioned in a cockpit. A steering angle of the steering wheel 7 (e.g., an angle or a change in angle resulting for pivoting or rotating the steering wheel) preferably is detected by a steering angle sensor 9. In one configuration, the steering angle sensor detects movement of a steering wheel shaft 8. The detected steering angle is transmitted to the control unit 12. In one configuration, the information is transmitted through a signal cable 10; however, in some configurations, the information may be transmitted wirelessly or in any other suitable manner.

A reaction force motor 14 preferably is coupled with the steering wheel shaft 8. The control unit 12 can calculates a reaction torque corresponding to the steering angle and an external force condition. In particular, the reaction force motor 14 can provide a reaction torque to the steering wheel 7 such that the operator has a level of force feedback (e.g., heavy sense, light sense or the like) during operation of the steering wheel.

A running condition detecting apparatus 16 also can be connected to the control unit 12. The running condition detecting apparatus 16 can comprise a speed sensor, an attitude sensor, a yaw rate sensor, a lateral acceleration sensor, an engine condition sensor, a shift position sensor, an accelerator sensor and the like. The speed sensor can have any suitable configuration. For example, an impeller attached to a bottom of the boat can directly detect a speed relative to the water body. In some configurations, the speed can be calculated by measuring positions relative to the ground using GPS. Alternatively, the speed can be predicted or estimated by watching an engine speed or a throttle valve opening. The attitude sensor detects an attitude of the boat in any suitable manner. In some configurations, the attitude sensor detects an attitude of the boat by detecting a rolling angle or a pitching angle of the hull using a gyroscope or the like. The yaw rate sensor detects a turning condition of the boat. The lateral acceleration sensor detects a centrifugal force during turning of the small watercraft. The engine condition sensor detects the throttle valve opening or the engine speed. The shift position sensor detects shift positions such as, for example, a forward position and a reverse position. The accelerator sensor detects a throttle valve opening condition by detecting a position of an accelerator lever. Other configurations also can be used. As one of the running conditions, an acceleration condition calculated using speed data can be added. A load sensor can be provided to the steering device of each outboard motor to detect a magnitude of external force which affects the hull during turning. The magnitude of external force also can be detected by a torque sensor provided to the motor of each steering device. Another torque sensor can be provided to an output shaft of an engine of each outboard motor or a propeller shaft thereof to detect a magnitude of thrust of the outboard motor as one of the running condition data. The running condition detecting apparatus 16 discussed above detects information relating to the operation of the boat and the detected data is sent to the control unit 12.

Figure 2:
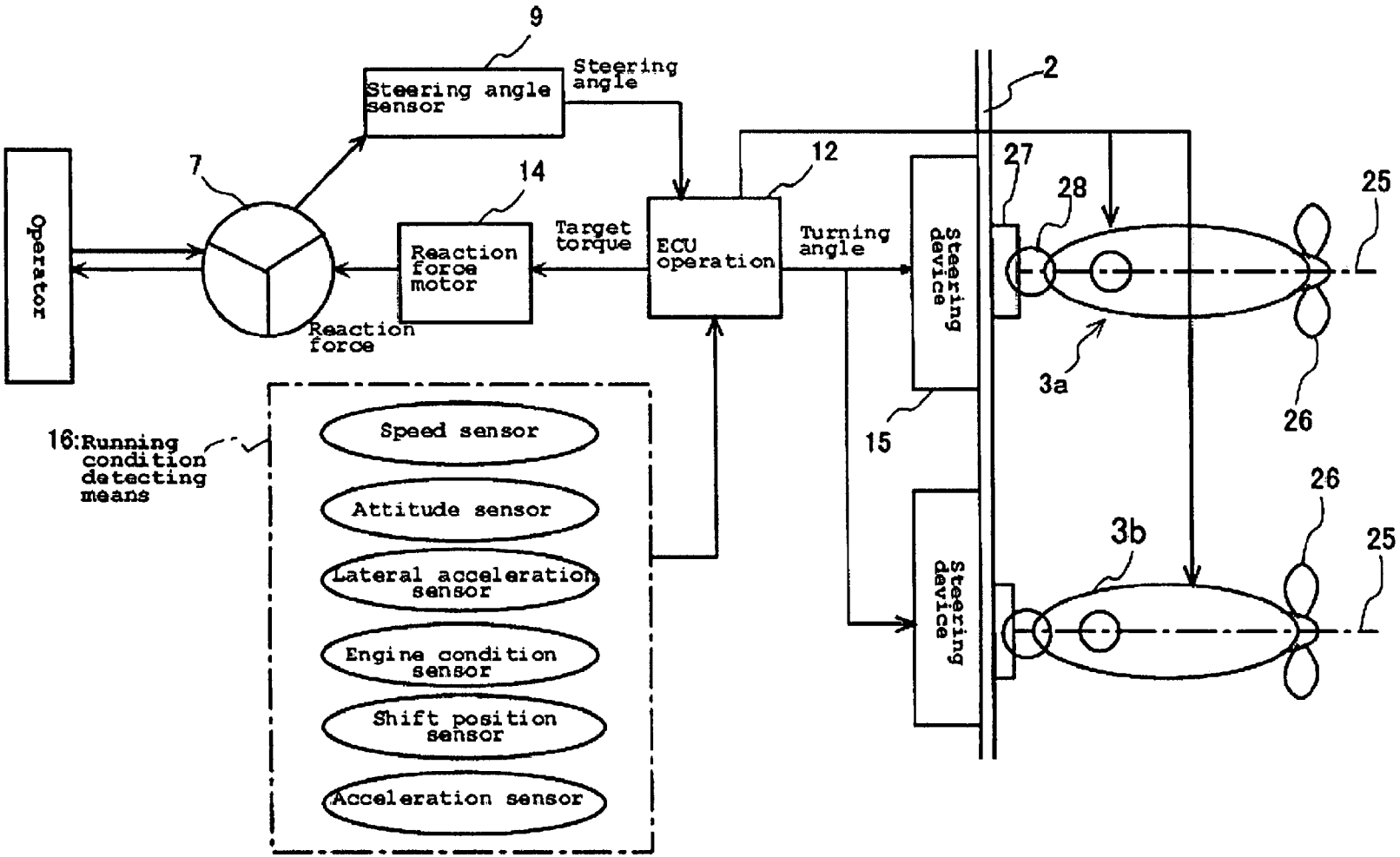
FIG. 2 is a block diagram of a majority of a steering control system that is arranged and configured in accordance with certain features, aspects and advantages of an embodiment of the present invention.

With reference to FIG. 2, a steering control system that is arranged and configured in accordance with certain features, aspects and advantages of an embodiment of the present invention is illustrated in a schematic form. As illustrated, the steering angle sensor 9 detects an angle of the steering wheel 7. The steering angle data are provided to the control unit 12. Data from one or more of the sources of data discussed above also are provided to the control unit 12. The control unit 12 calculates a target reaction torque that will be applied to the steering wheel such that force feedback can be transmitted to the boat operator through the steering wheel. In one configuration, the target reaction torque is determined based upon the steering angle data and one or more pieces of the data from the other data sources discussed above. The reaction force motor 14 then is operated in accordance with the target reaction torque to provide the reaction force to the steering wheel 7.

As discussed above, the two outboard motors 3*a*, 3*b* can be mounted to the transom board 2 (FIG. 1). The steering device 15 of each outboard motor 3*a*, 3*b* can be connected to the control unit 12 such that each steering device 15 receives from the control unit 12 a command regarding the amount of turning angle to drive the electric motor (not shown) to turn the associated outboard motor. The control unit 12 preferably is also connected to an engine (not shown) of each outboard motor 3*a*, 3*b*. Thus, the control unit 12 can control a throttle valve opening amount, a fuel injection condition (e.g., amount and/or timing) and an ignition timing of the engine so as to control the output of the outboard motors.

The respective outboard motors 3*a*, 3*b* can be mounted to the transom board 2 through transoms 27. As described later (FIG. 10), a height of each outboard motor preferably is adjustable to vary a height of a propeller 26 by adjusting a height of a propeller shaft 25. Each outboard motor 3*a*, 3*b* preferably also has a trim cylinder device 28 to allow the trim of the outboard motor 3*a*, 3*b* to be adjusted. Thereby, as described later (see FIGS. 9(A) and 9(B)), the angle of the propeller shaft 25 in the vertical direction can be adjusted.

In one embodiment that is arranged and configured in accordance with certain features, aspects and advantages of the present invention, the direction of the boat can be controlled merely by the adjustment of the respective engine outputs, trim angle and/or propeller height of the associated outboard motor. In other words, the boat can be steered in some configurations without the assistance of the steering device 15, which is used to turn the outboard motor from side to side.

Figure 3:
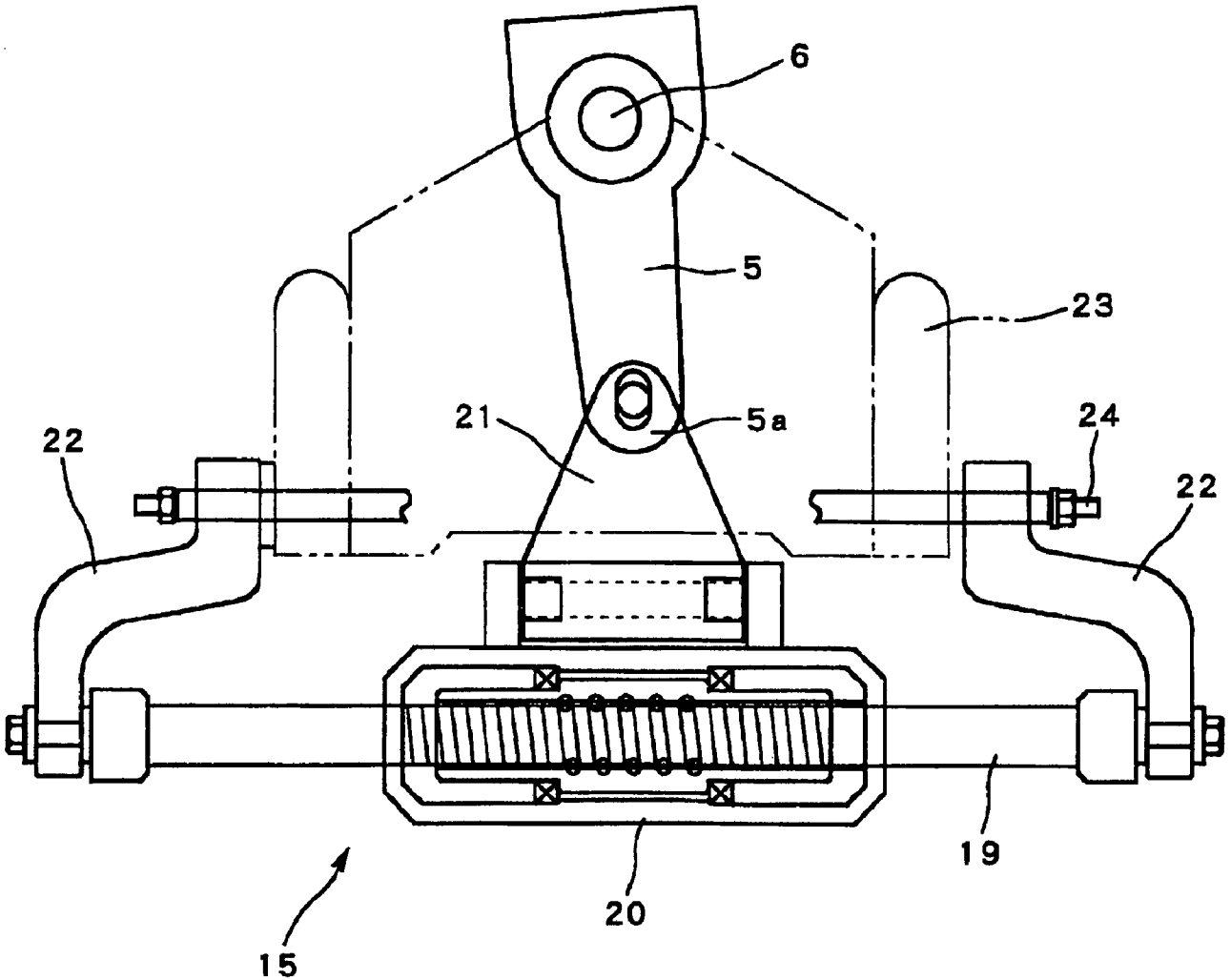
FIG. 3 is a view of a steering device that is arranged and configured in accordance with certain features, aspects and advantages of an embodiment of the present invention.

With reference now to FIG. 3, the steering device 15 comprises an electric motor 20, which motor preferably is a DD (Direct Drive) type motor. The electric motor 20 can be mounted to a threaded rod 19 such that it can translate along the threaded rod 19. Support members 22 connect respective ends of the threaded rod 19 to the transom board 2. A clamp section 23 of the clamping bracket is pivotally secured to the support members 22 by a tilt shaft 24. The steering bracket 5 is fixed to the swivel shaft 6 of each outboard motor 3*a*, 3*b* (FIG. 1), and the electric motor 20 is coupled with the front end 5*a* of the illustrated steering bracket 5 by a connecting bracket 21.

When the electric motor 20 slides along the screw rod 19, the outboard motor pivots about the axis of the swivel shaft 6 to be steered. As explained above, the control unit 12 provides signals to control the movement of the electric motor 20 such that the outboard motor pivots in accordance with the desired turning angle indicated through the steering wheel.

Figure 4:
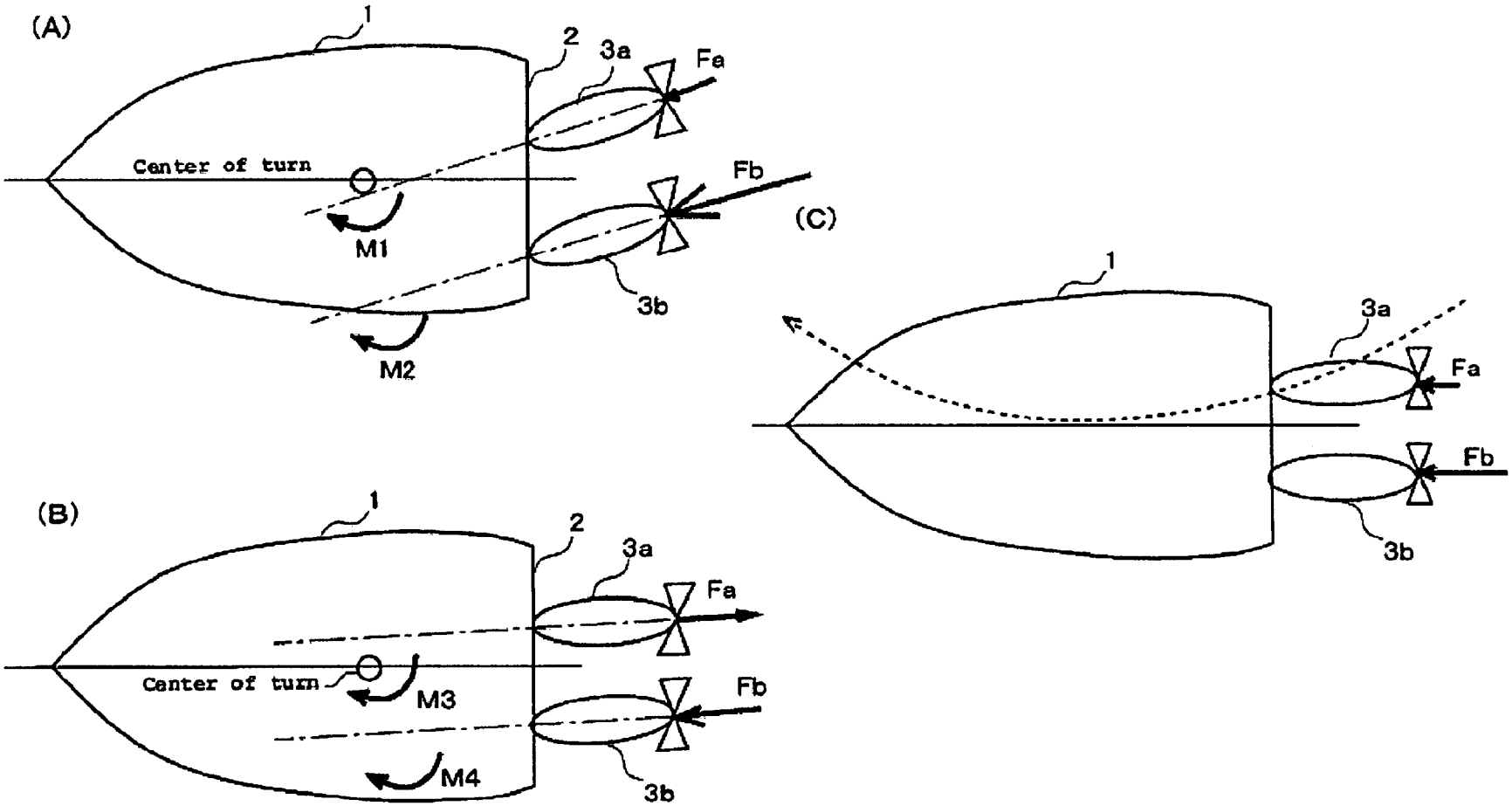
FIGS. 4(A) to 4(C) are illustrations used to explain three different turning operations of the small boat of FIG. 1.

FIGS. 4(A) to 4(C) illustrate of several different turning operations used with the small boat of FIG. 1. FIG. 4(A), similar to FIG. 8(A) described above, shows a turning operation in which the turning angle is large. In comparison with FIG. 8(A), the thrust (Fa) corresponding to the output of the outboard motor 3*a* located on the inside of the turn is decreased to be relatively smaller while the thrust (Fb) of the outboard motor 3*b* located on the outside of the turn is increased to be relatively larger. Thus, without decreasing the total thrust, i.e., while maintaining the initial total thrust, the pivotal moment about the center of turn can be increased such that the boat can turn in a smaller circle.

Figure 8:
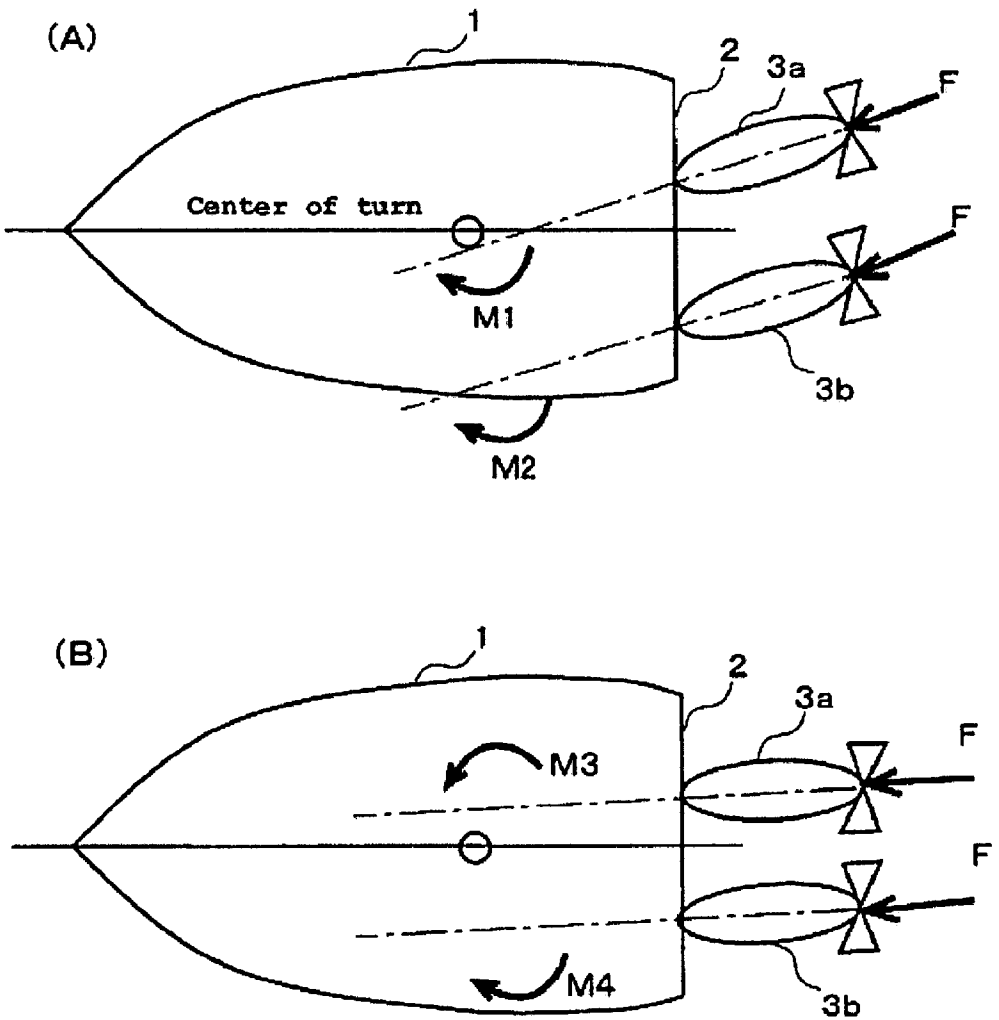
FIGS. 8(A) and 8(B) are illustrations used to explain the turning operation resulting in the development of certain features, aspects and advantages of an embodiment of the present invention.

FIG. 4(B), similar to FIG. 8(B) described above, shows a turning operation in which the turning angle is small. In FIG. 4(B), the output direction of the outboard motor 3*a* located on the inside of the turn is reversed so that the thrust (Fa) is reversed. Thereby, when the boat turns at an extremely low speed, the pivotal moment of the respective outboard motors 3*a*, 3*b* can be in the same direction relative to the center of the turn so that the total pivotal moment can be larger. The boat thus can turn more efficiently when the turning angle is not sufficiently large to cause the thrust vectors from both motors to lie on the same side of the center of the turn.

FIG. 4(C) shows that the boat turns by a difference between the output of the respective outboard motors 3*a*, 3*b* when the turning angle is zero degree. By making the thrust (Fb) of the outboard motor 3*b* larger than the thrust Fa of the outboard motor 3*a* (Fa<Fb), the boat can turn as indicated by the dotted line arrow.

Figure 5:
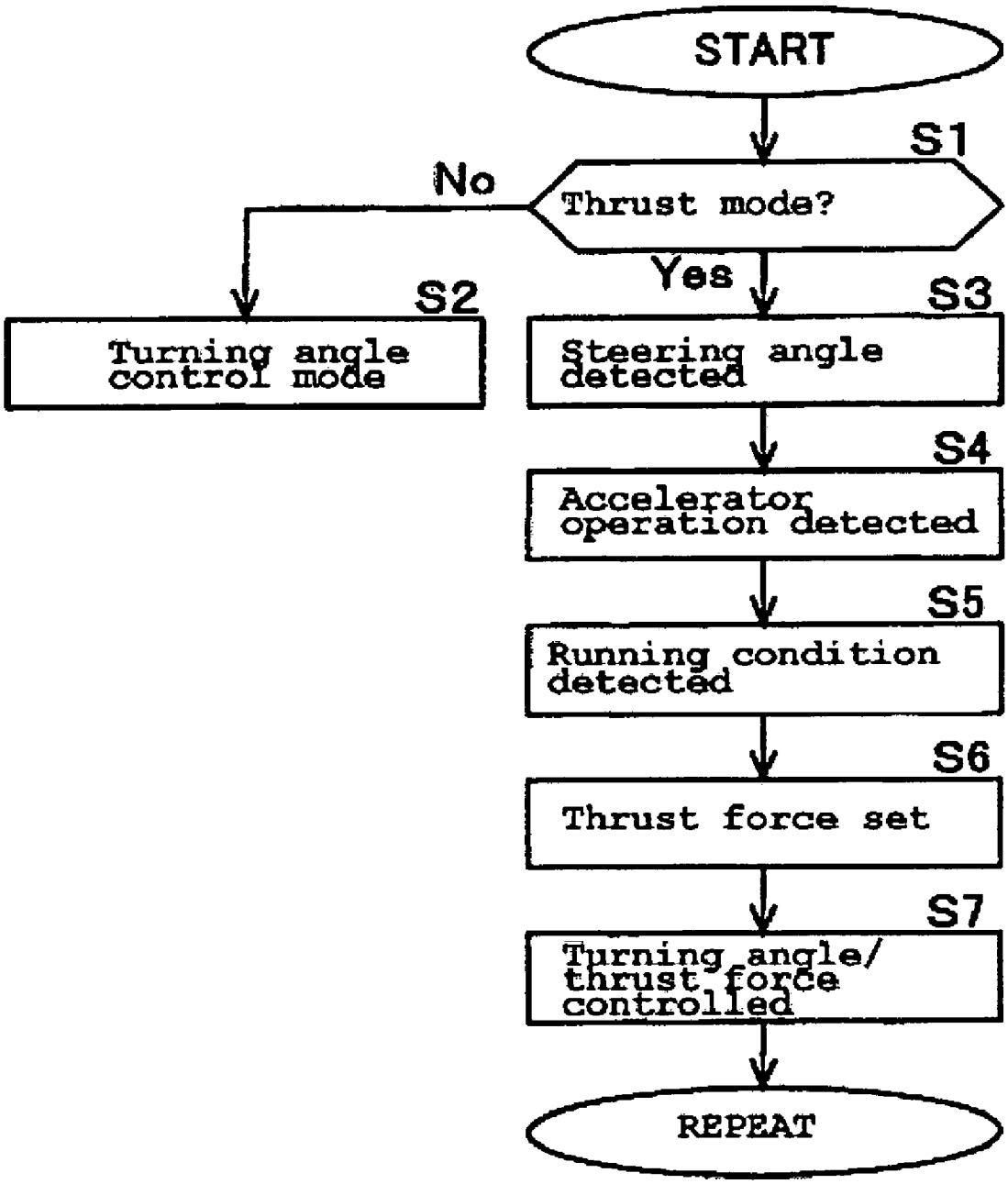
FIG. 5 is a flowchart of an output control configuration that can be used with the small boat of FIG. 1.

With reference now to FIG. 5, a turning operation control arrangement will be described. The illustrated turning operation control arrangement is arranged and configured in accordance with certain features, aspects and advantages of an embodiment of the present invention.

As illustrated, it is determined whether the turning operation control by the control unit 12 (FIG. 1, FIG. 2) is being made in a thrust mode or not (S1). The thrust mode employs a control manner whereby the control unit 12 follows a preset program and sets a thrust difference such that the difference in output of the respective outboard motors can be used to turn the boat. The control unit 12 determines whether the thrust mode is selected or not by watching a condition of a thrust mode on/off switch. The thrust mode on/off switch can be positioned, for example, adjacent to the accelerator lever in the cockpit. In some configurations, the switch can be mounted on the accelerator lever. In some configurations, instead of using the thrust mode on/off switch, the control unit 12 can automatically set the thrust mode when a detected speed is low. In yet other configurations, the control unit 12 can automatically set the thrust mode when a detected speed is low and the operator of the boat can select a preferred mode by the switch but one of the two will be subject to override under selected conditions.

If the thrust mode is not selected, the control unit 12 controls the respective outboard motors through altering only the turning angle in a turning angle control mode (S2). In other words, turning is caused through normal steering wheel manipulation and accelerator lever manipulation.

If the thrust mode is selected, the steering angle sensor (FIG. 2) detects a steering wheel pivotal movement angle made when the operator pivots the steering wheel (S3). Thereby, the desire of the operator for the turn is detected. Other techniques for detecting the desire of the operator to turn the boat also can be used.

An accelerator condition also is detected (S4). The accelerator condition can be detected by detecting a position of the accelerator lever or a throttle valve opening. Other techniques also can be used.

The running condition detecting apparatus 16 (FIG. 2) also can detect any other operating condition data, such as speed or the like (S5).

The thrusts of the respective outboard motors then are set to correspond with the steering angle, the accelerator condition and the detected running conditions. While FIG. 5 shows a particular order to detect the various data, the data can be detected simultaneously or in any other order. The output of the respective outboard motors can be adjusted and the thrust difference can be set so that the boat can efficiently turn in accordance with the detected running condition. Preferably, the thrust difference is adjusted to take into account the accelerator condition and the steering angle of the steering wheel to set the thrust difference. Also, preferably, a proper yaw rate range corresponding to the range of the steering angle can be set in accordance with the steering angle, and the output of the outboard motors can be adjusted to be within the yaw rate range while maintaining the desired thrust difference. Further, the thrust difference preferably is set in consideration of the speed so that the boat can steadily and efficiently turn in accordance with the operating speed (see FIG. 6). When the thrust difference is set, not only magnitudes of the outputs of the respective outboard motors but also the forward or reverse shift directions can be adjusted.

In addition, the thrust difference can be changed by adjusting the trim angles and/or the heights of the propellers of the respective outboard motors. When the trim angles are adjusted, thrust exerting directions of the respective outboard motors toward the hull vary in a vertical plane, which results in adjustment of the effective thrust as well (see FIGS. 9(A) and 9(B)). When the heights of the propellers are adjusted, positions of the points of action of the respective outboard motor's thrusts toward the hull in the vertical plane are adjusted (see FIGS. 10(A) and 10(B)).

Figure 11:
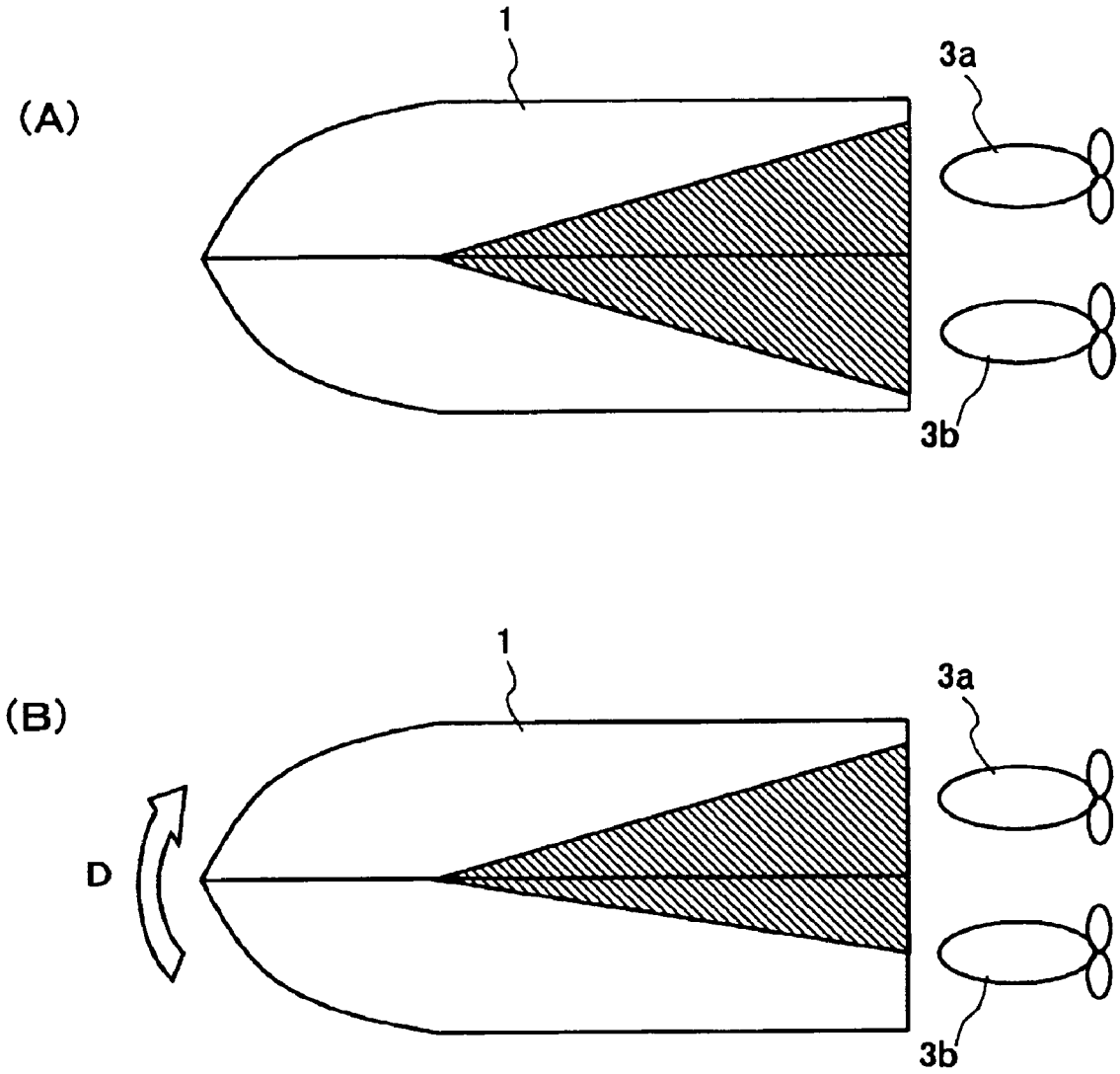
FIGS. 11(A) and 11(B) are illustrations used to explain contact areas of the hull bottom with water.

The outputs of the respective outboard motors then can be adjusted so that the set thrust difference is maintained (S7). Each output can be controlled using at least one of a throttle valve opening of the respective outboard motor, an ignition timing characteristic, a fuel injection condition (e.g., a duty ratio control such as, for example, a control of an injection time and an injection amount) and a mode shifter condition. Also, as discussed above, the thrust difference can be controlled by adjusting the trim angles and/or the heights of the propellers of the respective outboard motors (see FIG. 11).

Figure 6:
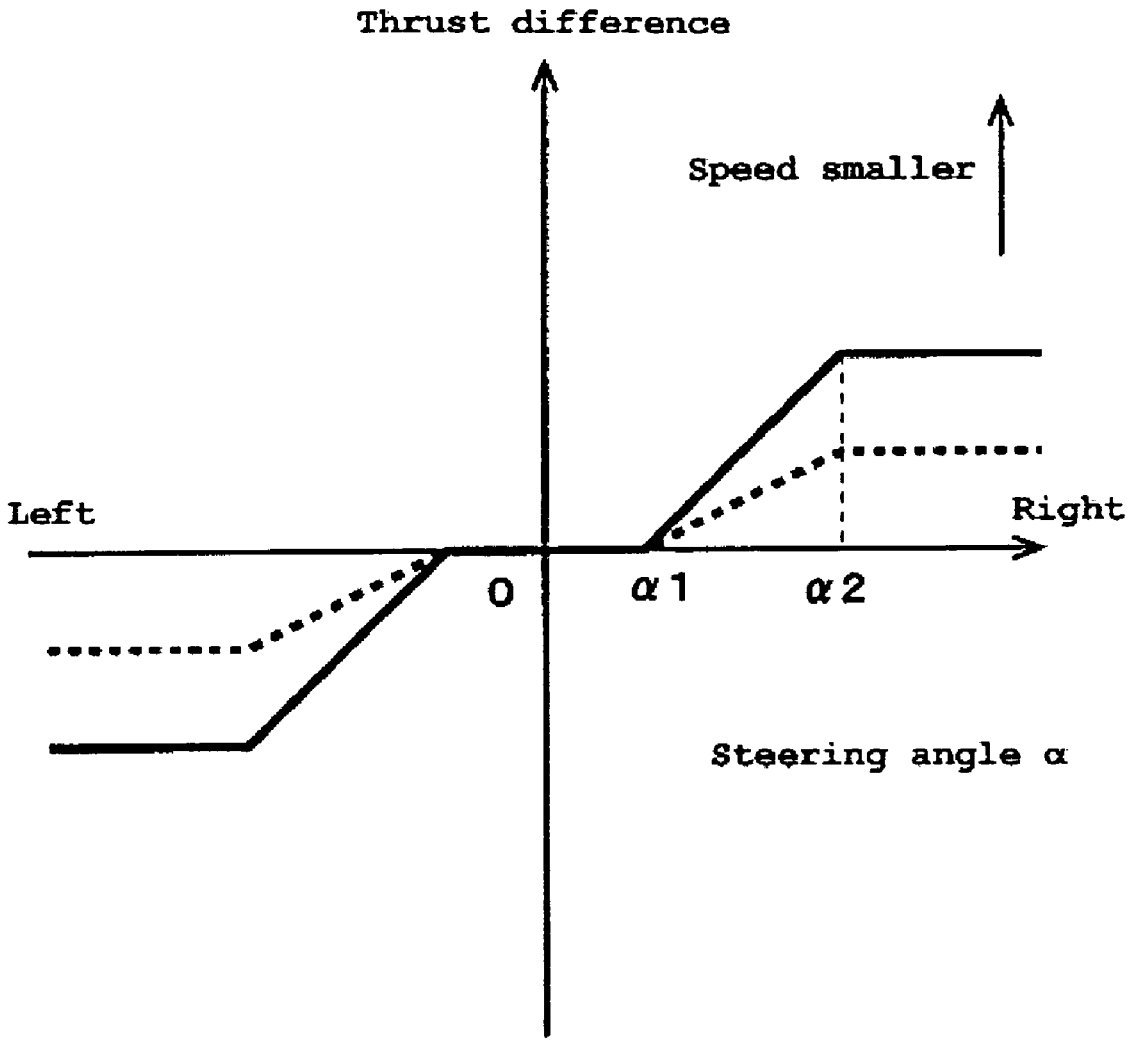
FIG. 6 is a graphical depiction of one control configuration in which the trusts of the two outboard motors are adjusted depending upon a steering angle input.

With reference now to FIG. 6, a graphical depiction is provided of an effect on the thrust difference based upon the desired steering angle as the speed varies. In FIG. 6, speed decreases in the vertical direction. As shown, the thrust difference is set as a function of a steering angle $\alpha$. The thrust difference is not set while the steering angle $\alpha$ is extremely small, i.e., the steering angle $\alpha$ is in a range between 0 and $\alpha 1$. The thrust difference is set in proportion to the steering angle while the steering angle $\alpha$ is in a range between $\alpha 1$ and $\alpha 2$. The thrust difference is set to be constant when the steering angle exceeds $\alpha 2$.

When the speed is lower, the thrust difference preferably is set larger. This is because, as the speed is lower, the turning operation can be more stable during any turning radius.

Figure 7:
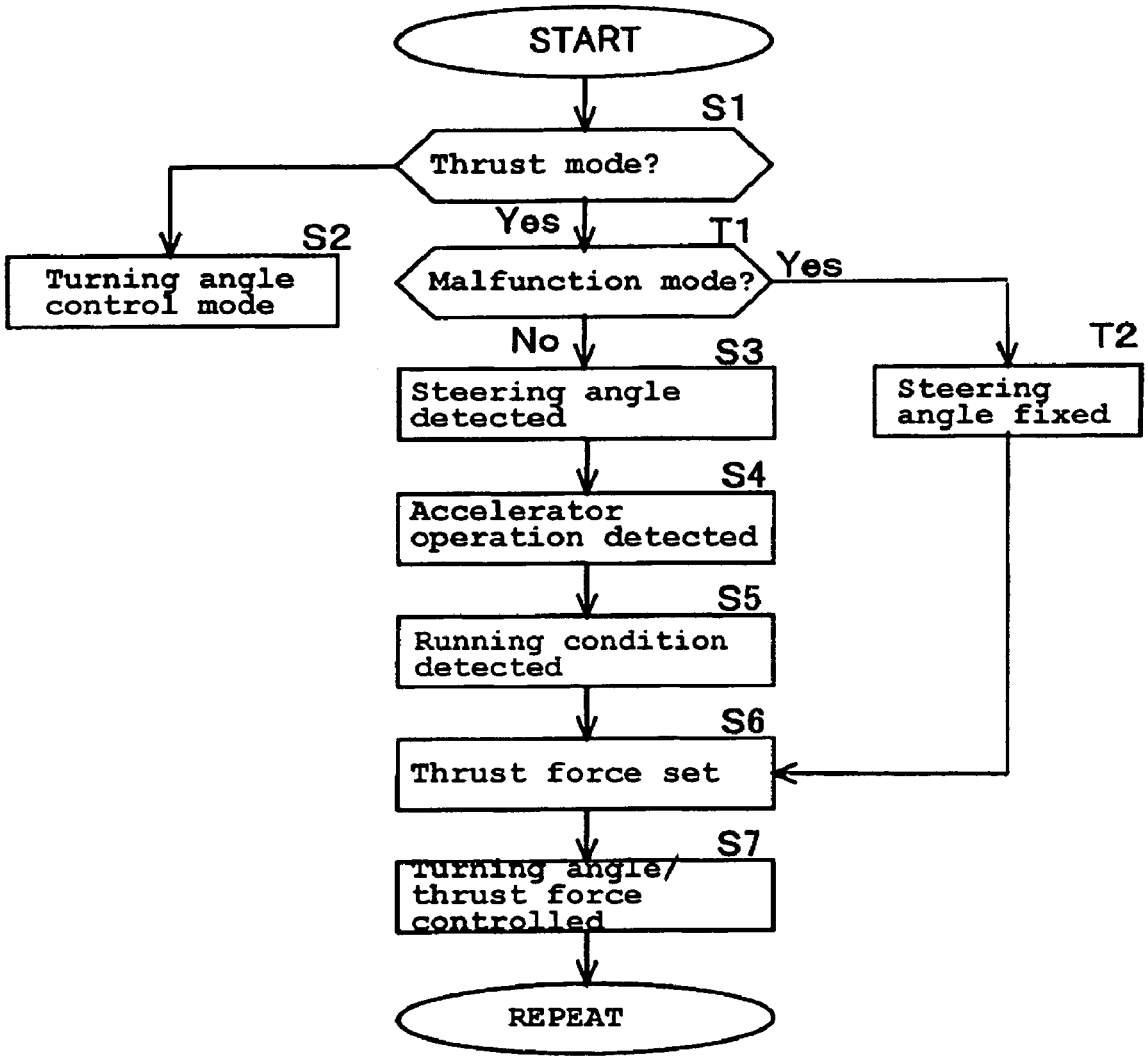
FIG. 7 is a flowchart of a malfunction control mode.

With reference now to FIG. 7, a malfunction control mode also can be provided. To simplify the discussion, the configuration illustrated in FIG. 7 is based upon the configuration of FIG. 5. In short, the configuration of FIG. 5 has been modified by adding a malfunction mode determining operation T1 after the thrust mode has been determined (S1). The malfunction detection (T1) can occur in any place within the routine in which data is being detected. In the illustrated configuration, if the thrust mode has been detected (S1), the control unit 12 determines whether the steering device is malfunctioning or not (T1). The control unit 12 determines that a malfunction is occurring if the detection amount detected by a position sensor of the steering device electric motor and the detection amount detected by a pivotal position sensor of each motor differ greatly from each other, at least one of the detection amounts is abnormal, the load sensor provided to each steering device outputs an abnormal detection amount, or similar situations occur. If the control unit 12 does not determine that a malfunction is occurring, the control unit 12 proceeds. If the control unit 12 determines the malfunction, the control unit 12 fixes the steering angle (T2).

When the turning angle of the steering device is fixed (T2), the turning operation preferably is made only by the difference between the outputs of the respective outboard motors. In one embodiment, when the malfunction is detected (T1), the electric motor is stopped and the turning angle is fixed at this position. Afterwards, the difference between the outputs of the respective outboard motors is calculated in accordance with the steering angle of the steering wheel, and the turning operation is by varying the output difference. If the motor is driven at the moment when the malfunction is detected but the turning angle can still be returned to a zero position, the motor is driven so that the turning angle is returned to the zero position (at which the steering device is placed at the center position and is under a straightly moving condition), and the difference between the outputs of the respective outboard motors is calculated at this center position to make the turning operation. Because the output difference is set after the outboard motors have returned to the center positions of their own, the turning operation can be made in good balance to the right or left direction.

Figure 9:
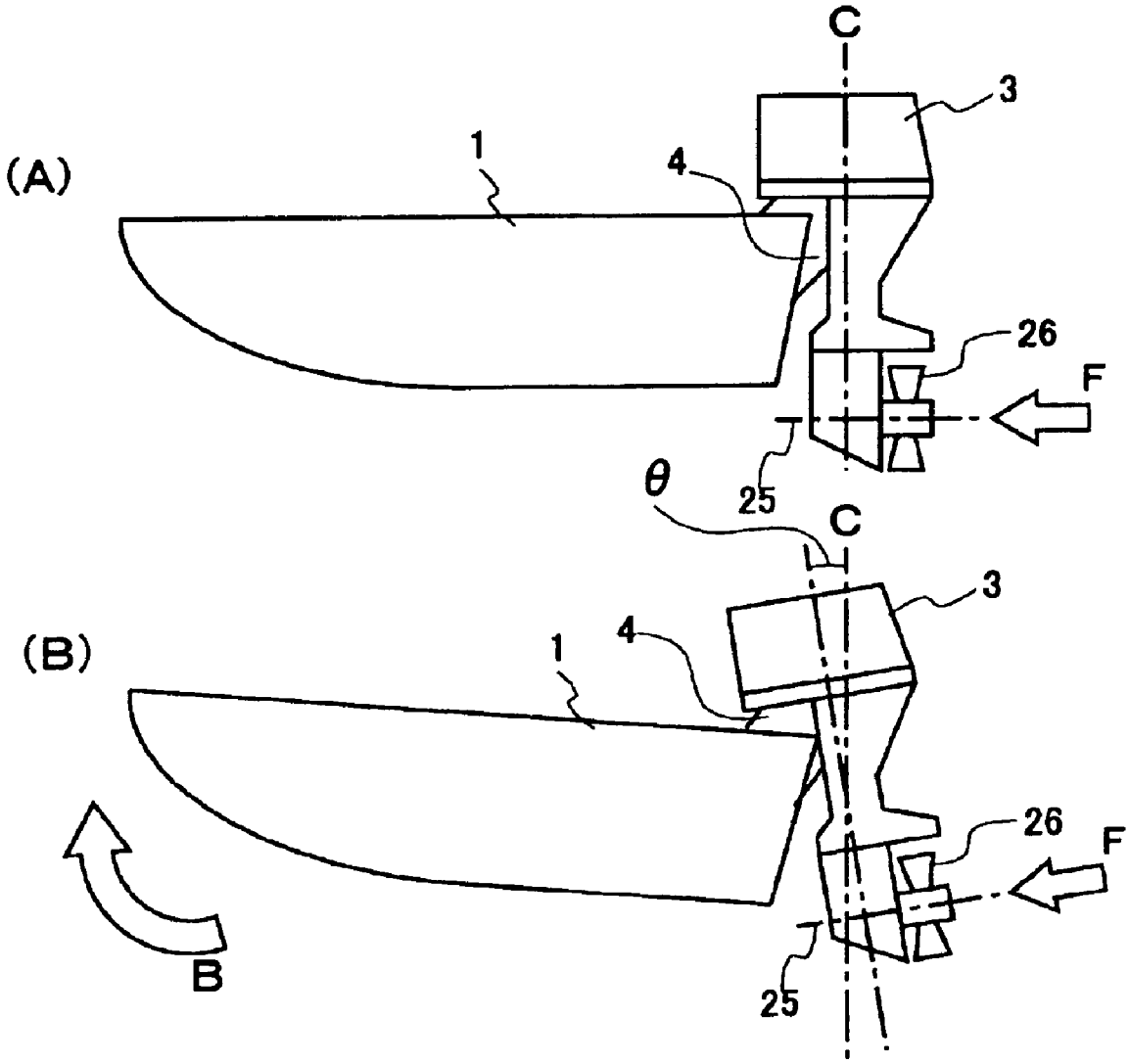
FIGS. 9(A) and 9(B) are illustrations used to explain a trim angle adjustment.

With reference now to FIGS. 9(A) and 9(B), trim adjustment will be explained. FIG. 9(A) shows a trim angle zero condition under which a reference axis C (for example, an axis of a crankshaft or driveshaft) of the outboard motor 3 extends generally vertically and the propeller shaft 25 extends generally horizontally. When the propeller shaft 25 of the propeller 26 extends generally horizontally, the thrust (F) generated by the propeller 26 toward the hull 1 is directed forward in a generally horizontal plane.

FIG. 9(B) shows a trim angle $\theta$ condition under which the outboard motor is trimmed up from the condition of FIG. 9(A) so that the reference axis (C) is inclined by the angle $\theta$ from the generally vertical direction and the propeller shaft 25 is inclined downwardly from the propeller 26. When the propeller shaft 25 inclines downwardly by the trim angle $\theta$ in the vertical plane including the reference axis (C), the direction of the thrust (F) created by the propeller 26 toward the hull 1 inclines downward by the angle $\theta$. A moment thus lifts (arrow (B)) a bow of the hull 1.

With reference now to FIGS. 10(A) and 10(B), height adjustment of the propeller will be explained. As discussed above, the outboard motor 3 is mounted to the transom 27 by the clamping bracket 4. The transom 27 is movable upward or downward relative to the hull 1 together with the outboard motor 3. FIGS. 10(A) and 10(B) show the top position and the bottom position of the transom 27, respectively. The transom 27 can be adjusted upward or downward within a range defined by the top position and the bottom position. When the transom 27 is adjusted, the position of the propeller shaft 25 in the vertical direction is adjusted and the position of the action point of the thrust (F) of the propeller 26 in the vertical direction is correspondingly adjusted. As shown in FIG. 10(B), when the position of the propeller 26 is lowered, a moment affects the hull 1 to raise the bow thereof upward (arrow (B)).

With reference now to FIGS. 11(A) and 11(B), contact areas of the hull bottom with the water will be explained. FIG. 11(A) shows a condition under which the respective outboard motors 3*a*, 3*b* are positioned at the same trim angle and the propellers thereof are placed at the same height. Under this condition, the right and left contact areas with the water (indicated by the hatching) are generally equal to each other. FIG. 11(B) shows a condition under which one outboard motor 3*b* is trimmed up (FIG. 9(B)) or the height of the propeller thereof is lowered (FIG. 10(B)). Under this condition, the water contact area on the corresponding side of the outboard motor 3*b* becomes smaller. Contact resistance of the boat with the water on this side thus decreases and a turning moment (indicated by the arrow (D)) affects the hull 1.

Advantageously, as described above, when the operator turns the steering wheel, the steering angle varies and the steering angle corresponding to the turning direction or radius is detected. Thus, the operator's desire to turn is detected. Using the control unit, the outputs of each of the respective propulsion units is adjusted or a thrust exerting direction of each of the respective propulsion units is adjusted through the trim angle or the propeller height such that the combined thrust and the running direction of the respective propulsion units can be used to turn the boat. The operator therefore can adjust the outputs of the respective propulsion units without operating the individual accelerator levers of the propulsion units. Instead, the operator need only turn the steering wheel to control the running direction of the boat such that the boat can easily and efficiently turn or run straight. In particular, the difference between the thrusts can be used to effectively steer the boat.

Although the present invention has been described in terms of certain embodiments and implementations, other embodiments and implementations apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. A small boat comprising a steering wheel, a steering angle sensor adapted to detect a steering angle of the steering wheel, a plurality of propulsion units mounted to a transom of the boat, each of the plurality of propulsion units coupled to an electrically operable steering device, and a control unit adapted to independently control an output of each of the plurality of propulsion units, wherein the control unit adjusts the output, a trim angle or a height of a propeller of each of the plurality of propulsion units in accordance with the detected steering angle and a running condition of the boat such that a total thrust of the plurality of propulsion units and running direction of each of the plurality of propulsion units can be used to effect turning operations of the boat and wherein, upon detection of a malfunction of at least one of the electrically operable steering devices, the control unit further is adapted to set a turning angle to a preset angle and to adjust the output of each of the propulsion units based upon the steering angle of the steering wheel such that the running direction is based upon a difference between the respective outputs.

2. The small boat according to claim 1, wherein the output of said each one of the propulsion units is adjusted using at least one of a throttle valve opening, an ignition timing characteristic, a fuel injection condition and a mode shifter condition.

3. The small boat according to claim 1, wherein the preset angle is a turning angle that is given under a malfunction condition.

4. The small boat according to claim 1, wherein the preset angle is a turning angle that is given when said each one of the respective propulsion units is returned to a straight-ahead position.

5. A small boat comprising a hull, a steering wheel mounted to the hull, the hull comprising a transom, a first propulsion unit and a second propulsion unit mounted to the hull generally in parallel, a steering device positioned on the small boat, the steering device adapted to cause steering movement of the first propulsion unit and the second propulsion unit, multiple sensors mounted to the small boat and providing data regarding multiple operating characteristics of the small boat, and means for controlling an output amount and output direction of the first propulsion unit and the second propulsion unit independently of each other such that the small boat can be steered at least in part by the relative output amounts and directions of the first and second propulsion units in response to movement of the steering wheel and data provided by at least one of the multiple sensors, and wherein, upon detection of a malfunction of at least one of the electrically operable steering devices, the means for controlling an output amount and output direction of the first and second propulsion units further is adapted to set a turning angle to a preset angle and to adjust the output of each of the propulsion units based upon the steering angle of the steering wheel such that the running direction is based upon a difference between the respective outputs.

6. The small boat of claim 5, wherein the multiple sensors are selected from the group consisting of a speed sensor, an attitude sensor, a yaw rate sensor, a lateral acceleration sensor, an engine condition sensor, a shift position sensor, and an accelerator sensor.

7. The small boat of claim 5, wherein output direction can be modified by turning at least one of the first and second propulsion units, by raising at least one of the first and second propulsion units, by trimming at least one of the first and second propulsion units, or by changing a rotational direction of an output shaft of at least one of the first and second propulsion units.

* * * * *